United States Patent [19]

Ikeda et al.

[11] 4,327,267

[45] Apr. 27, 1982

[54] HIGH FREQUENCY ENERGY SUPPLY IN A HIGH FREQUENCY HEATING APPLIANCE

[75] Inventors: Nobuo Ikeda; Hirofumi Yoshimura, both of Nara, Japan

[73] Assignee: Matsushita Electric Industrial Co., Ltd., Osaka, Japan

[21] Appl. No.: 173,496

[22] Filed: Jul. 29, 1980

[30] Foreign Application Priority Data

Sep. 10, 1979 [JP] Japan ..... 54-125843[U]

[51] Int. Cl.[3] ..... H05B 6/72

[52] U.S. Cl. ..... 219/10.55 F; 219/10.55 R

[58] Field of Search ..... 219/10.55 F, 10.55 D, 219/10.55 E, 10.55 R

[56] References Cited

U.S. PATENT DOCUMENTS 3,865,301 2/1975 Pothier et al. ..... 219/10.55 E X 4,132,239 1/1979 Bowen et al. ..... 219/10.55 D X

FOREIGN PATENT DOCUMENTS 2850236 8/1979 Fed. Rep. of Germany ... 219/10.55 F

*Primary Examiner*—B. A. Reynolds

*Assistant Examiner*—Philip H. Leung

*Attorney, Agent, or Firm*—Wenderoth, Lind & Ponack

[57] ABSTRACT

There is disclosed an energy feeding device for installation in a high frequency heating appliance which includes a heating chamber, a high frequency oscillator for supplying a high frequency energy to the heating chamber, a waveguide for transmitting the high frequency electromagnetic wave generated from the high frequency oscillator, and a rotary antenna for radiating the high frequency electromagnetic wave so transmitted by the waveguide into the heating chamber. The rotary antenna has a revolving drive shaft, made of a material with a low dielectric loss and is connected to a drive source, a metal pipe which is connected to the revolving drive shaft at its socket end. The socket end of the metal pipe is expanded and rounded off, thereby substantially preventing sparking under light load.

3 Claims, 5 Drawing Figures

HIGH FREQUENCY ENERGY SUPPLY IN A HIGH FREQUENCY HEATING APPLIANCE

BACKGROUND OF THE INVENTION

1. Field of the Invention

This invention relates to an energy feeding device for a microwave heating appliance. In accordance with this invention there is provided an improved rotary antenna for feeding high-frequency electromagnetic energy into a heating chamber which is stable in quality and in performance, and which does not cause sparking even though it comprises a thin-walled metallic pipe for weight reduction purposes.

2. Brief Description of the Prior Art

A conventional antenna of the above-mentioned type comprises a hollow metal pipe which is connected with a revolving drive shaft made of low-loss dielectric material in order to prolong its rotation life and to reduce the size and cost of the drive source, e.g. a motor.

However, such an antenna, made of a thin-walled metal pipe, has a sharp edge at the end which is inserted into a waveguide. Even though a substantial electric field is available near the antenna, the electric field is concentrated around the sharp edge of the pipe. This leads to local sparking under operating conditions involving a large reflection coefficient, such as light loading, resulting in not only the operation being rendered unstable but also the sparking which is continuous, tends to damage the antenna. The above problems are substantially solved by this invention.

SUMMARY OF THE INVENTION

An objective of this invention is to provide a high frequency energy supply for a high frequency heating appliance. More particularly, the invention provides an improved rotary antenna which does not cause sparking in an appliance. According to one aspect of this invention, the connecting end of an antenna pipe is connected to a drive shaft and is folded outwardly and back and is rounded off so as to prevent sparking even under conditions involving a high reflection, such as under light load conditions. By rounding the connecting end of the antenna and increasing its diameter so that there is a radial clearance between the end of the connecting end and the drive shaft not only a broader band frequency characteristic is imparted to the antenna but antenna performance is stabilized against variations of frequency. When the antenna end is not in close contact with the drive shaft, a thin-walled antenna has inadequate mechanical strength and is readily deformable. However, by folding back the antenna end or by affixing a metal ring to the end an improvement in mechanical strength can be realized.

Furthermore, by enlarging the inner diameter of the antenna end so that the radius of the bore thereof is larger than the size necessary for folding the end inwardly and back, a radial clearance with respect to the drive shaft is created and foreign matters such as the iron particles etc. produced by the rotational friction between the drive shaft and its bearing can be received in the clearance rather than being deposited in a harmful place within the heating appliance.

BRIEF DESCRIPTION OF THE DRAWINGS

This invention will be described in further detail, reference being had to the accompanying drawings in which.

DETAILED DESCRIPTION OF THE INVENTION

Figure 1:
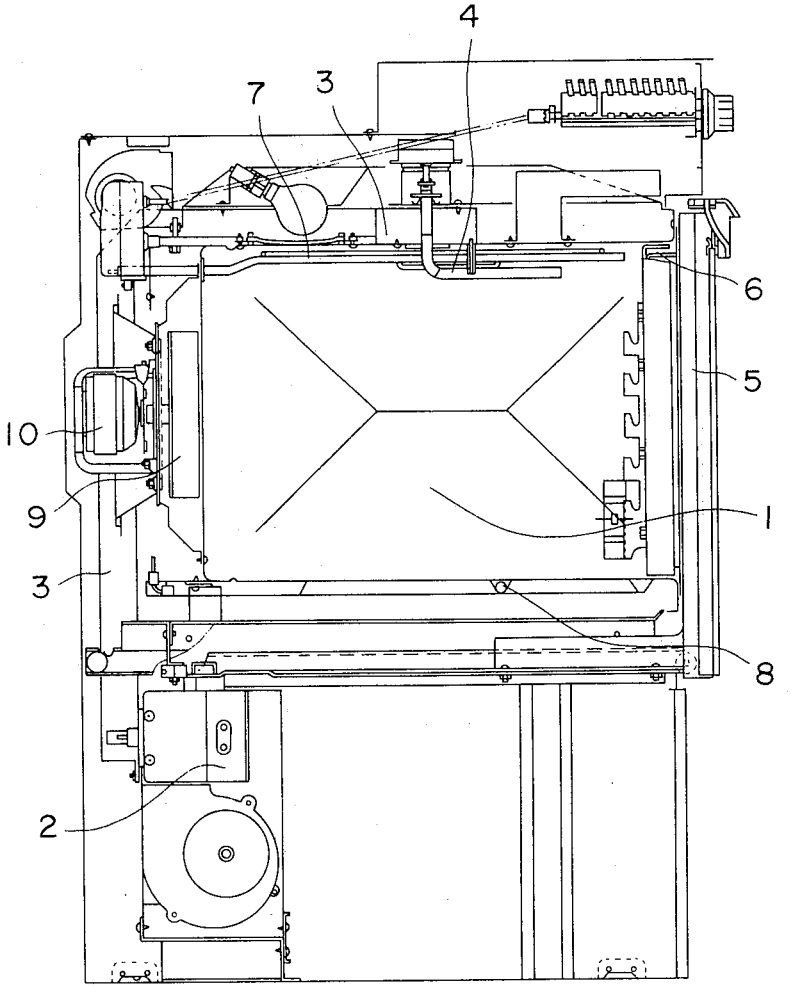
FIG. 1 is a sectional side-elevational view showing a preferred embodiment of a high frequency heating appliance according to this invention.

In FIG. 1, there is shown an oven (1) which includes a magnetron (2) as a high frequency oscillator, and a waveguide (3). The high frequency energy generated by said magnetron (2) is guided through said waveguide (3) and radiated into a heating chamber of oven (1) by a rotary antenna (4).

The oven (1) has a front opening which can be closed by a door (5) and is provided with a choke means (6) which is formed in such a manner that it will move into the body of oven (1) upon closure of the door (5). The oven (1) further includes electric heaters (7) and (8), a heated air circulating fan (9) and a motor (10) for driving the fan.

Figure 2:
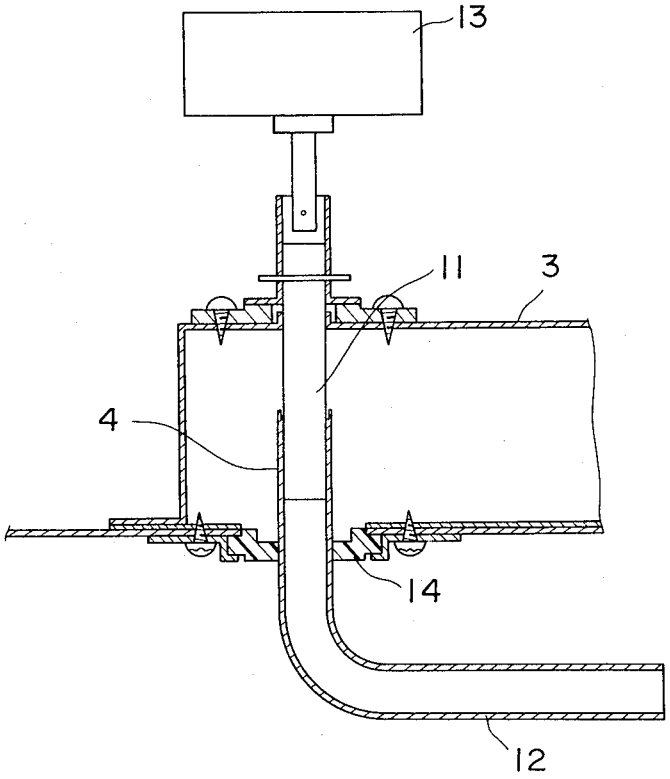
FIG. 2 is an enlarged sectional view showing an energy feeding device of the preferred embodiment of the present invention.

Referring, now, to FIG. 2, the rotary antenna (4) comprises a revolving drive shaft (11) made of low-loss dielectric material, for example ceramic, and a metallic pipe (12). The revolving drive shaft (11) is coupled at one end thereof to the drive motor (13) and is rotatably supported by the waveguide (3). At the other end the drive shaft (11) is connected to the metal pipe (12) which is rotatably supported by a cover (14). Thus, the rotary antenna rotates and is supported at two points.

Figure 3A:
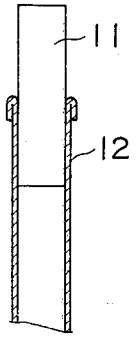
FIGS. 3*a, b* and *c* are, respectively, enlarged sectional views each showing an embodiment of a shafting joint of the rotary antenna as installed in the preferred embodiment of the present invention.

As illustrated in FIG. 3, the drive shaft (11) and metal pipe (12) are connected to each other in such a manner that the free end of the shaft (11) is fitted into the free end of metal pipe (12). And as can be seen from FIG. 3*a*, the free end of metal pipe (12) is folded outwardly.

Figure 3B:
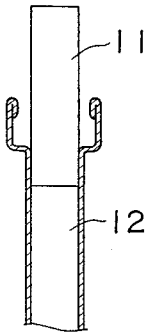
Figure 3C:
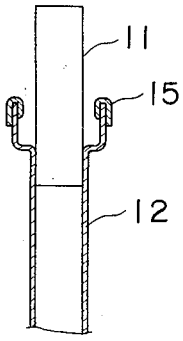

In the embodiment illustrated in FIG. 3*b*, a socket or fitted portion of the pipe (12) is expanded and the end of the expanded portion is folded back inwardly. FIG. 3*c* shows another embodiment, wherein the socket or fitted portion of pipe (12) is expanded and the end of the expanded portion is capped with a metal ring.

In all of the above embodiments, the end of the antenna pipe is rounded off, and therefore, there is no concentration of electric field around the end and, hence, no sparking. Referring to FIG. 3*a*, although the outwardly folded portion has a sharp edge, it is situated away from the antenna end and does not cause sparking. In the case of the arrangement as shown in FIG. 3*a*, a minor clearance is created between the folded-back edge and the antenna wall so that sparking may take place in the clearance. Therefore, the arrangement illustrated in FIG. 3*b* is more desirable.

Experimental data indicates that even if the antenna end is rounded off sparks are induced depending on the wall thickness of pipe, however the field strength near the antenna is also an influential factor. Thus, when a 0.5 mm thick pipe was folded outwardly (R about 1.0), sparks were encountered. In contrast, when a 0.7 mm thick pipe was folded outwardly (R about 1.5), no sparking occurred.

What is claimed is:

1. In an energy feeding device for a high frequency heating appliance including a heating chamber, said energy feeding device having a high frequency oscillator for generating high frequency electromagnetic wave energy, a waveguide for transmitting high frequency electromagnetic wave energy from said oscillator, a rotary antenna for transmitting high frequency electromagnetic wave energy from said waveguide into the heating chamber, and a driving means for rotating said rotary antenna, the improvement comprising:

a revolving drive shaft connected to said driving means at one end of said drive shaft and being made of a material having a low dielectric loss;

said rotary antenna being a metal pipe and having a socket portion at one end thereof which connects said rotary antenna to said drive shaft;

the end of said socket portion having a substantially larger inner diameter than said one end of said drive shaft which forms a radial clearance between the inner periphery of the socket end and the outer periphery of said drive shaft; and the end of said socket portion being rounded.

2. The improvement as claimed in claim 1, wherein the end of said socket portion is folded radially inward and in the direction of said rotary antenna.

3. The improvement as claimed in claim 1, wherein said socket portion includes a metal ring which is fitted over the end of said socket portion.

* * * * *